US006223920B1

(12) United States Patent
Lane et al.

(10) Patent No.: US 6,223,920 B1
(45) **Date of Patent: *May 1, 2001**

(54) HOT-FILLABLE BLOW MOLDED CONTAINER WITH PINCH-GRIP VACUUM PANELS

(75) Inventors: Michael T. Lane, Brooklyn; Mark O. Blystone, Adrian; Christopher A. Brown, Clinton, all of MI (US)

(73) Assignee: Sclimalbach-Lubeca, AG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/081,533

(22) Filed: May 19, 1998

(51) Int. Cl.[7] ..... B65D 1/02; B65D 23/10

(52) U.S. Cl. ..... 215/384; 215/381; 215/383; 220/669; 220/675; 220/771

(58) Field of Search ..... 215/379, 381, 215/383, 384; 220/666, 669, 675, 771

(56) References Cited

U.S. PATENT DOCUMENTS

| | | | | |
|---|---|---|---|---|
| 4,749,092 | * | 6/1988 | Sugiura et al. | 215/381 |
| 4,805,788 | | 2/1989 | Akiho . | |
| 4,818,575 | * | 4/1989 | Hirata | 215/381 X |
| 4,863,046 | * | 9/1989 | Collette et al. | 215/382 X |
| 5,141,120 | * | 8/1992 | Brown et al. | 215/384 X |
| 5,141,121 | | 8/1992 | Brown et al. | 215/384 |
| 5,148,930 | * | 9/1992 | Ota et al. | 215/384 |
| 5,199,588 | * | 4/1993 | Hayashi | 215/381 |
| 5,226,550 | * | 7/1993 | Mikolaitis et al. | 215/386 |
| 5,392,937 | | 2/1995 | Prevot et al. | 215/384 |
| 5,472,105 | | 12/1995 | Krishnakumar et al. | 215/384 |
| 5,598,941 | | 2/1997 | Semersky et al. | 215/384 |
| 5,704,503 | * | 1/1998 | Krishnakumar et al. | 215/381 |
| 5,735,420 | * | 4/1998 | Nakamaki et al. | 215/381 X |
| 5,758,790 | * | 6/1998 | Ewing, Jr. | 215/384 |

* cited by examiner

*Primary Examiner*—Sue A. Weaver
(74) *Attorney, Agent, or Firm*—Harness, Dickey & Pierce, P.L.C.

(57) ABSTRACT

A vacuum-pinch grip panel structure of a hot-fillable container. The panel structure includes an upper rib, a lower rib, an intermediate panel and a grip portion. The upper and lower ribs extending laterally across the structure while the intermediate panel and the grip portion extend between the upper and lower ribs. The upper rib, lower rib, intermediate panel and grip portion are connected together for relative movement therebetween. The movement being pivoting movement of the upper rib, lower rib, intermediate panel and grip portion generally toward a center area of the structure upon reduced internal container pressures.

30 Claims, 4 Drawing Sheets

HOT-FILLABLE BLOW MOLDED CONTAINER WITH PINCH-GRIP VACUUM PANELS

BACKGROUND OF THE INVENTION

1. Field of the Invention

The present invention generally relates to a hot-fillable, blow molded plastic container. More particularly, the invention relates to containers of the above variety having a panel section resisting undesirable deformation and operating as both a vacuum panel, to accommodate reductions in product volume during cooling of the hot filled product, and a pinch-grip, for ease of handling.

2. Description of the Prior Art

Hot-fillable plastic containers have become commonplace for the package of products (e.g., juices) which must be filled into the container while hot to provide for adequate sterilization. During filing, the product is typically dispensed into the container while at a temperature of 180° F. and above. Such a container is known as a "hot-fill". After filling, the container is sealed or capped and, as the product cools, a negative internal pressure forms within the sealed container. If not properly designed, the negative internal pressure will cause the container to deform in unacceptable ways, both from an aesthetic and a performance perspective.

Biaxially-oriented polyethylene terephthalate (PET) containers have long been used to receive the hot-filled product with a resulting minimal amount of distortion in the container after cooling. To accommodate the shrinkage and negative internal pressure, the most often employed method is the incorporation of a plurality of recessed vacuum panels into the body portion of the container. The vacuum panels are designed so that as the product cools, they will deform and move inwardly. In one style of container having vacuum panels, the vacuum panels are equidistantly spaced around the body of the container and separated by land portions. A wrap around label is then used to cover all of the vacuum panels and provide the container with an aesthetically pleasing look.

A major problem with containers of the above mentioned vacuum panel design is that they are not easily handled by the end consumer, particularly in 48 oz., 64 oz. and larger varieties.

Plastic containers having specifically designed gripping areas, hereinafter referred to as pinch-grips, were originally seen in containers for "cold-fill" applications. Not being specifically designed for receiving a hot-fill product, those containers, which did not include vacuum panels, could not accommodate the hot-filling procedure or the decrease in internal pressure which occurs in a hot-fill application.

U.S. Pat. Nos. 5,141,120 and 5,141,121, both to Brown et al., are believed to be the first patents which disclose vacuum panels and pinch-grips in combination in a hot-fill container. More particularly, these patents illustrate and describe the incorporation of the vacuum panels and the pinch-grips together into a common vacuum/pinch-grip (VPG) panel of the container.

Since the Brown patents issued, other containers have also adopted the VPG panel construction. Examples of such patents include U.S. Design Pat. No. 334,457 and U.S. Pat. Nos. 5,392,937; 5,472,105 and 5,598,941.

By providing a container with pinch-grips, the use of wrap around labels (as described above) yielded to the use of spot labels in the front and rear of the container. The use of spot labels, however, decreases the overall labeling area of the container. From a bottler's perspective this is undesirable. By combining the pinch-grips and vacuum panels into a common panel as done in the above referenced patents, the front and rear label areas can be provided in such a manner that eliminates the need for vacuum panels beneath the label. Instead of vacuum panels, horizontal stiffening ribs are often provided in these label panels for reinforcement and to ensure that distortion will not occur as a result of the decrease in internal pressure during cooling of the product.

When properly designed, the VPG panels will move inwardly as the container's internal pressure decreases and the product cools. The VPG panels have been seen to generally eliminate significant deformation in the container outside of the VPG panel area as a result of the internal pressures acting upon the container. However, the internal pressure acting on the VPG panels themselves have been seen to cause creases, distortions and other deformations. This is unintended and aesthetically undesirable.

In view of the above and other limitations, it is a primary object of the present invention to provide a VPG panel structure which resists deformation and distortion during filing, cooling and subsequent handling of the container.

Another object of the present invention is to provide a hot-fillable, blow molded plastic container having a VPG panel structure which resists deformation and distortion during filing, cooling and subsequent handling of the container.

A further object of this invention is to provide a container with improved top load characteristics in its shoulder region.

Still another object of this invention is to provide a container with increased labeling capabilities relative to other containers with spot labels.

SUMMARY OF THE INVENTION

In achieving the above and other objects, the present invention provides a hot-fillable, blow molded plastic container suited for receiving a product which is initially filled in a hot state, the container subsequently being sealed so that cooling of the product creates a reduced volume of product and a reduced pressure within the container. This is achieved through implementation of a novel VPG panel structure in the sidewall of the container. Another aspect of the invention is that the container has increased top load capabilities and also provides for increased labeling on the container. This is achieved through the geometry of the shoulder of the container.

The shoulder portion of the present container includes a first conical section, which, at its greatest diameter, merges with a shoulder label section. The shoulder label section defines a substantially vertical wall portion around the shoulder portion of the container. Between the shoulder label section and the body of the container is a second conical section. This second conical section increases the diameter of the container out to its maximum diameter. A recessed groove connects the shoulder label section with the second conical section. The recessed groove is distinctively identified on the container as defining a diameter which is less than the diameter defined by the shoulder label section and the maximum diameter defined by the second conical section.

A VPG panels according to the present invention includes four primary components in its construction. Provided across both the top and bottom of the VPG panel are vacuum ribs. The ribs extend across the width of the VPG panel and when viewed in horizontal cross-section the ribs are seen to be coaxial or concentric with the container and set inward relative to the maximum diameter of the container. Extending between the vacuum ribs of each VPG panel is a grip portion and an intermediate panel. The grip portion and the intermediate panel are join by an axial transition wall. The grip portion defines a region which is recessed to the interior of the container greater than that of the intermediate panel and the vacuum ribs.

The three tiered relative heights of the VPG panel structures provide the VPG panel with three components that operate independently, but in conjunction with one another, to accommodate the reduced internal pressure of the container. Each of these structures generally pivots inwardly of the container, about an adjacent hinge portion located generally around the perimeter of the VPG panel, to eliminate unwanted distortion across the VPG panel and other portions of the container.

The front and rear label panels are separated by the VPG panels.

Additional objects, features and advantages of the present invention will become apparent to a person skilled in the art after consideration of the following description, taken in conjunction with the appended claims and figures.

DETAILED DESCRIPTION OF THE PREFERRED EMBODIMENT

Figure 1:
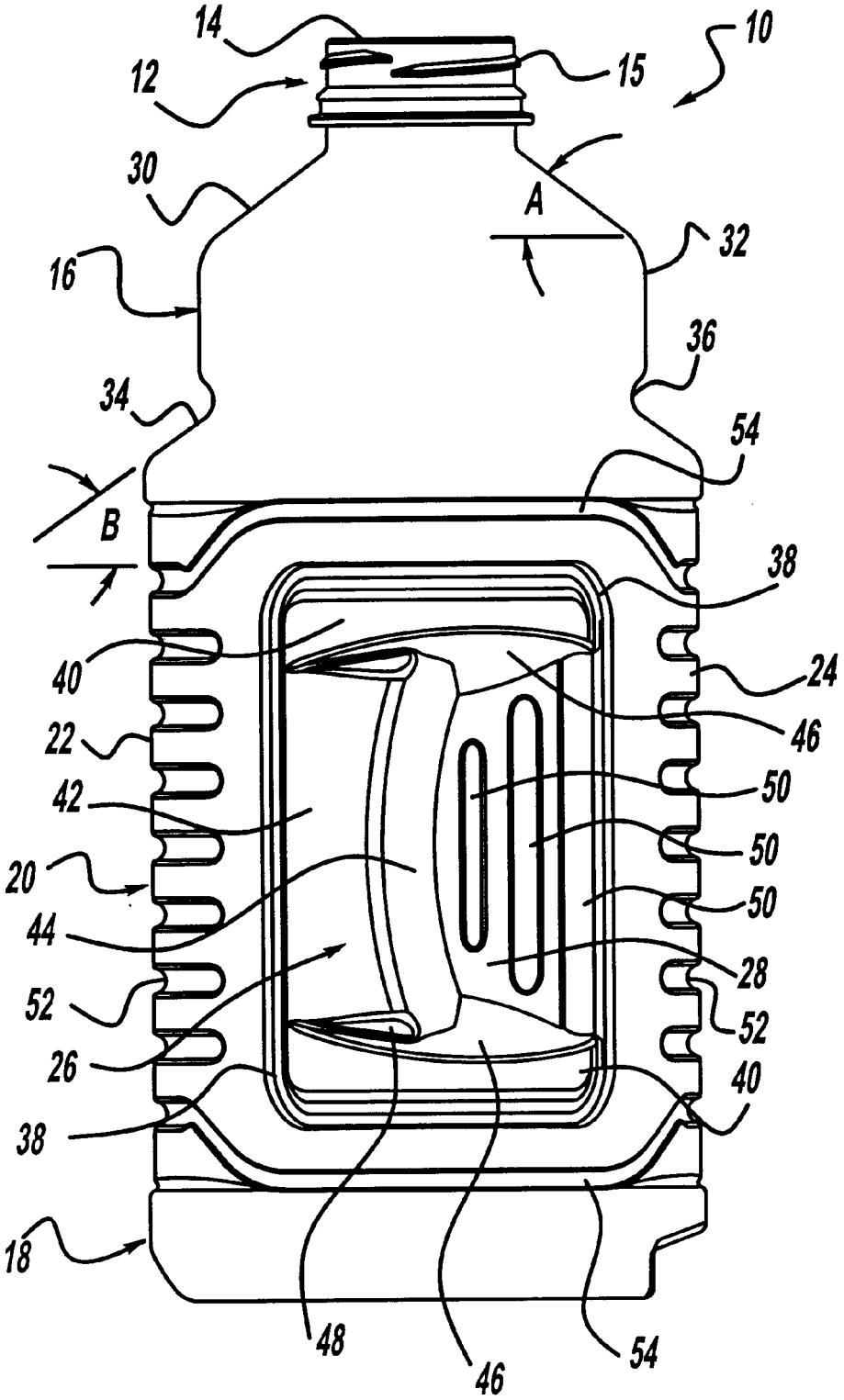
FIG. 1 is a side elevational view of a container embodying the principles of the present invention.

Referring now to the drawings, FIG. 1 illustrates a hot-fillable, blow molded plastic container 10 which embodies the principles of the present invention. The container 10 is designed to be filled with a product, typically a liquid, while the product is in a hot state. After filling, the container 10 is sealed and cooled. During cooling, the volume of product in the container 10 decreases and this in turn results in a decreased pressure within the container 10.

Since the container 10 is designed for "hot-fill" applications, the container is manufactured out a plastic material, such as PET, and is heat set enabling it to withstand the entire hot-fill procedure without undergoing uncontrolled and unconstrained distortions. Such distortions are typically a result of either the temperature and pressure during the initial hot-filling operation or the subsequent partial evacuation of the container's interior as a result of cooling of the product. During the hot-fill process, the product is normally heated to a temperature of about 180° F. or above and dispensed into the already formed container at these elevated temperatures.

Figure 2:
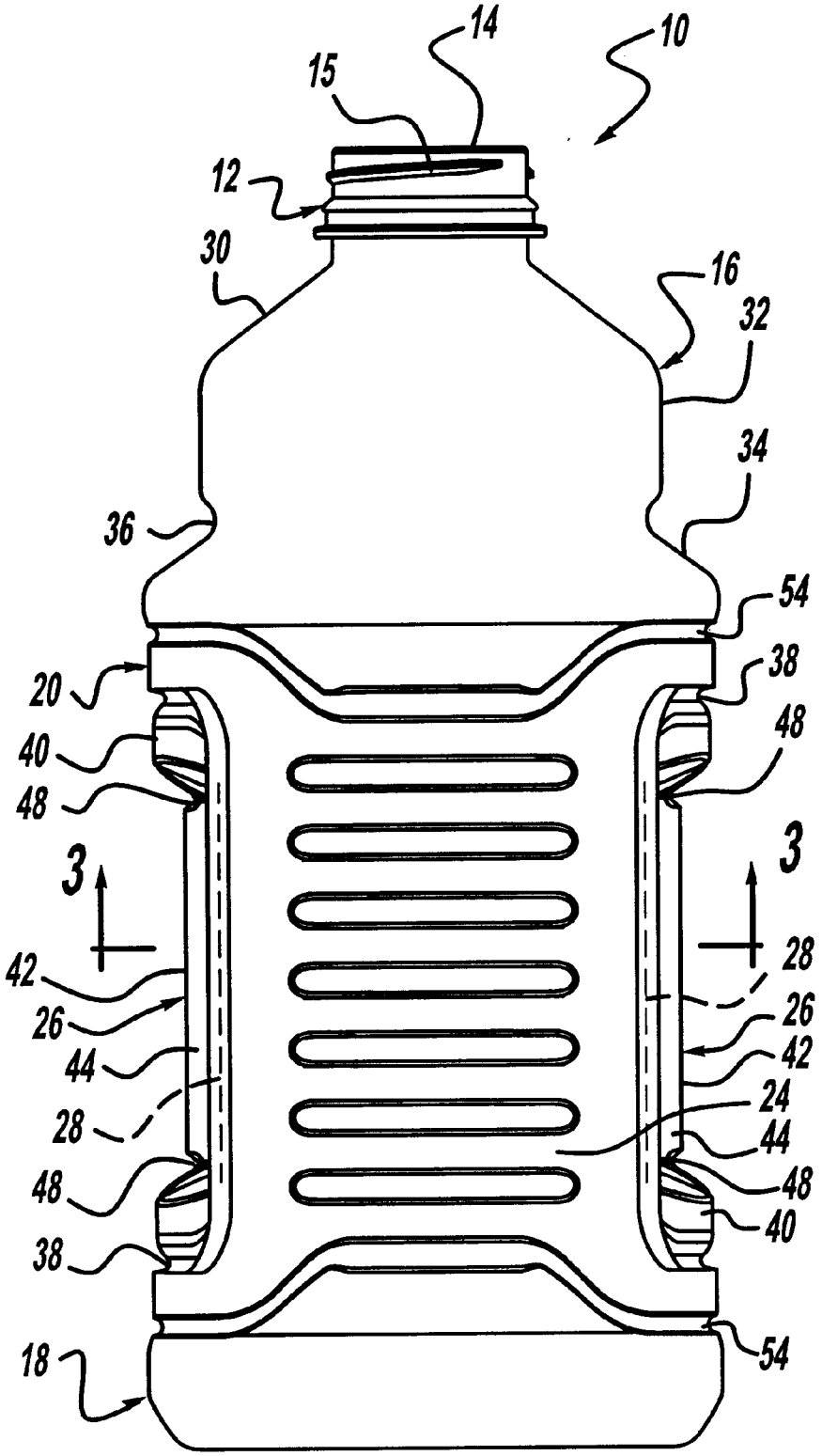
FIG. 2 is a rear elevational view of the container seen in FIG. 1.

As seen in FIGS. 1 and 2, the container 10 generally includes a neck 12, which defines the mouth 14 of the container, a shoulder portion 16 and a bottom portion 18. A cap (not shown) engages threads 15 on the neck 12 to close the mouth 14 and seal the container 10.

Figure 3:
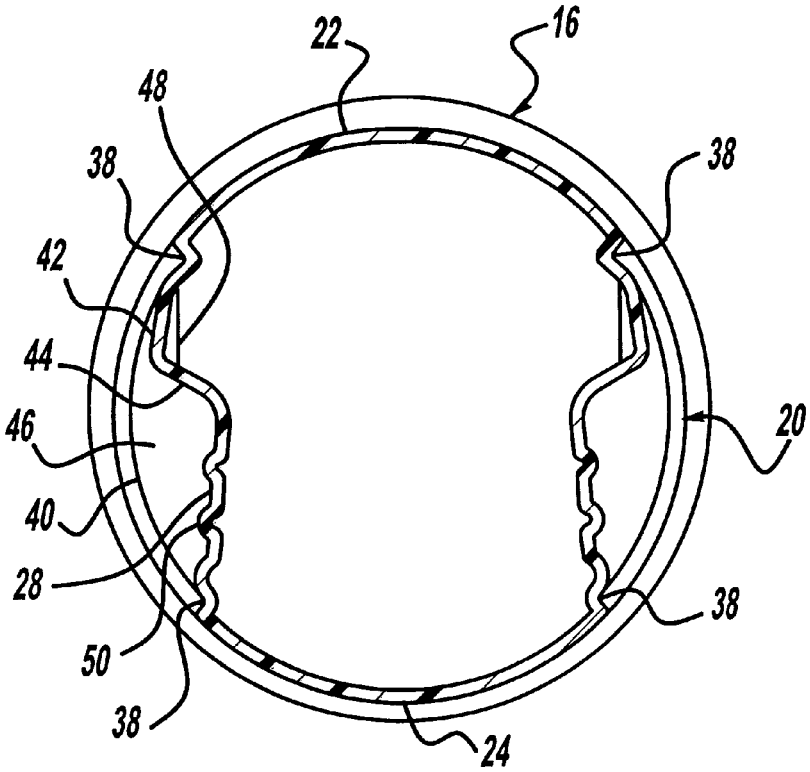
FIG. 3 is a cross sectional view of a container embodying the principles of the present invention taken substantially along line-3—3 of FIG. 2.
Figure 4:
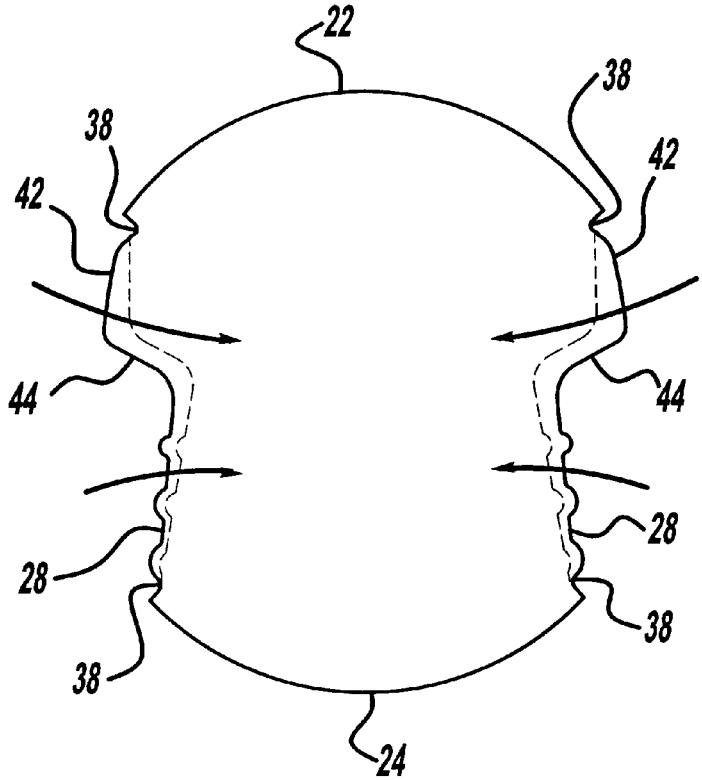
FIG. 4 is diagrammatic cross sectional view, similar to that seen in FIG. 3, illustrating, via the arrows depicted thereon, the relative movements of the structures of the VPG panel as a result of the cooling of the product and the reduction in internal pressure within the container.

Extending between the shoulder portion 16 and the bottom portion 18 is the sidewall or body 20 of the container 10. Generally, the body 20 has a cylinder-like shape which, when viewed cross-sectionally, is annular. As seen in FIG. 3, the body 20 includes an arcuate front label panel 22 which extends vertically between the shoulder portion 16 and the bottom portion 18 of the container 10. The body 20 also includes an arcuate rear label panel 24 that similarly extends vertically between the shoulder portion 16 and the bottom portion 18 of the container 10. The front and rear label panels 22 and 24 are located diametrically opposite one another and, if desired, the rear label panel 24 can be of a substantially lesser arcuate extent than the front label panel 22. Front and rear labels (not shown) can be affixed to the front label panel 22 and the rear label panel 24 by conventional means, such as by an adhesive.

Separating the front label panel 22 from the rear label panel 24 and forming deviations into the interior of the container 10 relative to the remainder of the body 20 are a pair of vacuum/pinch-grip panels 26 (hereinafter just "VPG panels"). Located on opposing sides of the container 10, the VPG panels 26 each include grip portions 28 which are structured such that a person handling the container 10 can grasp the container 10 between the thumb and fingers of one hand.

As briefly mentioned above in the background section of this document, one problem with the use of spot labels is that they reduce the overall area for container labeling. The container 10 of the present invention adds additional labeling capabilities to the container 10 through the construction of its shoulder portion 16. Currently, most hot fill containers utilized what may be generally referred to as a "double-domed" shoulder. A double-domed shoulder exhibits a continuously curved profile from the neck of the container down to the body of the container. The curvature is such that the shoulder profile exhibits a characteristic upper bulb and lower bulb.

In the present invention, proceeding downwardly from the neck 12, the shoulder portion 16 lacks the above mentioned double-domed feature. Instead, the shoulder portion 16 of the present container 10 includes a first conical section 30 proceeding downward and outward from the neck 12. At its greatest diameter, the first conical section 30 merges with a shoulder label section 32. The shoulder label section 32 defines a substantially vertical wall portion around the container 10 in the shoulder portion 16. Between the shoulder label section 32 and the body 20 of the container 10 is a second conical section 34. The second conical section 34 increases the diameter of the container 10 out to its maximum diameter. A recessed groove 36 is provided between the shoulder label section 32 and the second conical section 34 and connects these two sections together. The recessed groove 36 can be distinctively identified on the container 10 in that it defines a diameter, specifically an outer diameter of the container 10, which is less than the outer diameter defined by the shoulder label section 32 and the maximum diameter of the container 10 defined by the second conical section 34.

By providing the container with the vertical wall defined by the shoulder label section 32, a wrap-around or sleeve label is received in the shoulder portion 16 of the container 10 thereby increasing the overall labeling capabilities of the container 10. This was not previously possible with double-domed containers.

Relative to a horizontal plane or a plane normal the substantially vertically face defined by the shoulder label panel 32, it is seen in FIG. 1 that an angle A defined by the first conical section 30 is greater than an angle B defined by the second conical section 34. In the preferred embodiment, angle A is approximately 37° and angle B is approximately 35°. While particular angles are given for angles A and B, it is believed that the present invention could be operatively constructed with angles varying therefrom. It is believed that in preferred configurations, angle A will remain greater than angle B.

Relative to the substantially vertical face defined by the shoulder label section 32, it can be seen that the recessed groove 36 provides a dramatic deviation into the shoulder portion 16 from the lower edge of the shoulder label section 32. Incorporating this recessed groove 36 with the shoulder label section 32 has been found to allow the use of standard preforms, constant wall thickness, during the blow molding the container 10. The shoulder label section 32 and the recessed groove 36 cooperate to capture an increased amount of material in the shoulder portion 16, particularly the recessed groove 36, of the container 10. The increased thickness of the recessed groove 36 results in the shoulder portion 16 being better able to resist ovalization and having an increased top load capability. The present invention therefore can be seen to utilize geometry, not process or preform modifications, to obtain the increased thickness in the shoulder portion 16. Previous containers have utilized process and preform modifications, not geometry. A result of this increased thickness is that a container according to the principles of the present invention has approximately a 25% increase in top load capabilities over a double-domed container of similar weight.

While the container 10 includes two VPG panels 26, it is seen that the VPG panels 26 are the same in their construction. Accordingly, only one VPG panel need and will be described in detail herein.

A VPG panel 26 according to the present invention includes four primary components in its construction. The perimeter of the VPG panel 26 is defined by an outwardly concave hinge rib 38 which is continuous there around. The hinge rib 38 defines a hinge point for the various elements of the VPG panel allowing those elements to flex relative to the remainder of the body 20 under the influence of the reduced internal container pressure.

A vacuum rib 40 is provided across both the top and bottom of the VPG panel 26. The upper and lower edges of the respective upper and lower vacuum ribs 40 are seen to merge with the hinge rib 38 in that the hinge ribs 38 extend across the width of the VPG panel 26. When viewed in horizontal cross-section, it will be noted that the hinge ribs 38 are coaxial or concentric with the container 10 and set inward relative to the maximum diameter of the container 10.

Located and extending between the two vacuum ribs 40 of each VPG panel 26 is the grip portion 28 (mentioned above) and an intermediate panel 42. Both the grip portion 28 and the intermediate panel 42 are seen to extend the full length between the upper and lower vacuum ribs 40. The grip portion 28 and the intermediate panel 42 each occupies approximately half of the width of the VPG panel 26 with the grip portion 28 being located adjacent to the rear label panel 24 and the intermediate panel 42 being located adjacent to the front label panel 22.

The grip portion 28 and the intermediate panel 42 join together via an axial transition wall 44 provided between the two. The grip portion 28 defines a region which is recessed to the interior of the container 10 greater than that of the intermediate panel 42 and the axial transition wall 44, as such, provides the transition for that change in depth. Like the grip portion 28 and intermediate panel 42, the axial transition wall 44 extends between the upper and lower hinge ribs 38. As best seen in FIG. 1, the axial transition wall 44 exhibits a curvature relative to the longitudinal axis of the container 10. This curvature may be best described as being concave relative to the grip portion 28 and convex relative to the intermediate panel 42.

Transaxial transition walls 46 join the upper and lower hinge ribs 38 with the grip portion 28, intermediate panel 42 and the axial transition wall 44. Since the grip portion 28, intermediate panel 42 and axial transition wall 44 are all set inwardly relative to the hinge ribs 38, the transaxial transition walls 46 angle toward the interior of the container from the vacuum ribs 40. As seen in the side elevational views of FIGS. 1 and 2, the transaxial transition walls 46 are arcuate with respect to a horizontal plane through the container 10. More specifically, the transaxial transition walls 46 can be described as concave relative to the center of the VPG panels 26. The arcuate nature of the transaxial transition walls 46 is such that the upper transaxial transition walls 46 arcs generally upward as it extends from the hinge rib 38 adjacent to the front label panel 22 to the hinge rib 38 adjacent to the rear label panel 24 on the opposing side of the VPG panel 26. Conversely, the lower transaxial transition walls 46 arcs generally downward as it extends from the hinge rib 38 adjacent to the front label panel 22 to the hinge rib 38 adjacent to the rear label panel 24 on the opposing side of the VPG panel 26. This arcing is prominently displayed or seen where the upper and lower hinge ribs 38 respectively merge with the upper and lower transition walls 46.

The arc or curvature of the transaxial transition walls 44 and 46 is provided for more than aesthetic purposes. The incorporation of the arc of the transaxial transition walls 44 and 46 operates to reinforcement to the other structures of the VPG panels 26 reducing and eliminating the formation of creases or other distortions across the various structures, and in particular the intermediate panel 42, as induced by the decreased internal container pressure. It has been found that if the nature of the transaxial transition walls 44 and 46 is made respectively vertical and horizontal instead of arcuate as described above, creases and distortions can result in both the vacuum ribs 40 and the intermediate panels 42. Those distortions were even more substantial and further resulted the possibility of a crease through and beyond the corner of the VPG panel 26 itself if the intermediate panel 42 and vacuum ribs 40 are provided with a common height or as a common structure, instead of as separate structures with different heights. Again, such creasing and distortion as a result of handling or the decreased interior container pressure results in an unacceptable container.

An additional feature of the VPG panel 26 is the inclusion of recessed ribs 48 located at the merger of the intermediate panel 42 with the transaxial transition walls 46. These recessed ribs 48 are readily seen in FIGS. 1 and 2. The recessed ribs 48 operate as a pivot area between the intermediate panel 42 and the transitional walls 46/vacuum ribs 40, as is more fully described below.

Figure 5:
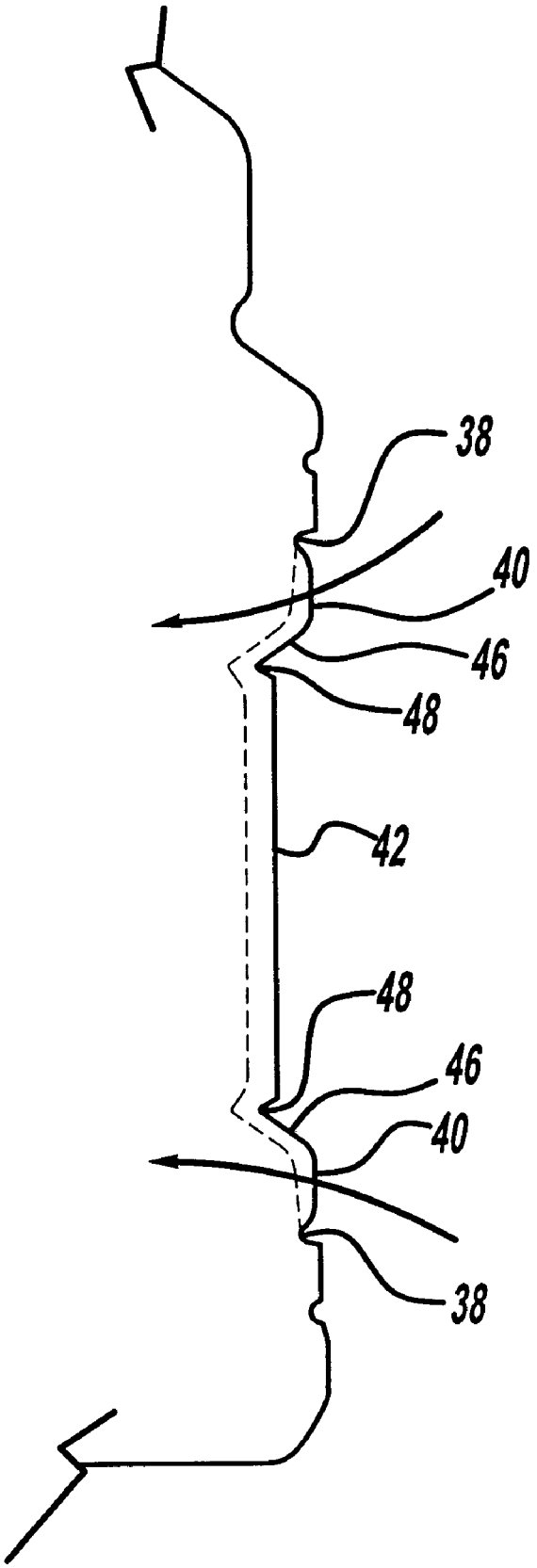
FIG. 5 is a diagrammatic longitudinal view of the container further illustrating, via the arrows depicted thereon, the relative movement of the structures of the VPG panels as a result of the cooling of the product and the reduction in internal pressure within the container.

The three tiered relative heights of the VPG panel 26 structures (the vacuum ribs 40, the intermediate panel 42 and the grip portion 28) provides the VPG panel 26 with three components that operate independently but in conjunction with one another to accommodate the reduced internal pressure of the container 10, after cooling of the product contained therein. As reduced pressure onsets within the container 10, each of these structures generally pivots inwardly of the container 10 about that portion of the hinge rib 38 adjacent thereto. The relative pivoting of the above mentioned structures is diagrammatically illustrated in FIGS. 5 and 6. As will be appreciated from the above description, the incorporation of the recessed ribs 48 eliminate unwanted distortion across the intermediate panel 42, which would and could otherwise result because of the different direction of pivoting for each of the above referenced elements and the generally flat nature of the intermediate panel 42.

To allow for better gripping of the container, the grip portion 28 is additionally provided with raised ribs 50. The raised ribs 50 are generally oriented along the axis of the container 10.

The front and rear label panels 22 and 24 are each provided with a plurality of generally horizontally oriented recessed ribs 52. These ribs 52 structurally reinforce the label panels 22 and 24 minimize or eliminate unwanted distortion in those areas of the container 10. In addition to the ribs 52, circumferential ribs 54 are provided both above and below the VPG panels 26 adjacent to the merger of the body 20 with the shoulder portion 16 and the bottom portion 18. These circumferential ribs 54 include a drop down portion in the front and rear label panels 22 and 24 which respectively form the uppermost and lowermost reinforcement ribs in the label panels 22 and 24. Alternatively, the circumferential rib 54 can be partial and terminate adjacent to the front and rear label panels 22 and 24.

A minor rib 56 is also provided at the joinder of the body 20 with the shoulder 16. The minor rib 56 generally exhibits a width which is approximately half the dimension of the inset or step down from the shoulder portion 16. Preferably the minor rib 56 is outwardly concave but it is anticipated that the rib may alternatively be inwardly concave. The minor rib 56 is illustrated as being located only above or below the label panels 22 and 24 and only partial in circumferential extend. If desired the rib 56 can also be provided above and below the VPG panels 26, either by extending continuously around the container 10 or by extending as an interrupted rib there around the container 10. The minor rib 56 operates to further reinforce the transition from the shoulder 16 to the body 20 of the container 10.

While the above description constitutes the preferred embodiment of the present invention, it will be appreciated that the invention is susceptible to modification, variation and change without departing from the proper scope and fair meaning of the accompanying claims.

We claim:

1. A vacuum-pinch grip panel structure of a hot-fillable container, said panel structure comprising:

an upper rib, a lower rib, an intermediate panel, a grip portion, an axial wall, and a transaxial wall, said upper and lower ribs extending laterally across said structure, said intermediate panel and said grip portion located between said upper and lower ribs, said axial wall connecting said intermediate panel with said grip portion and extending to said transaxial wall, and said transaxial wall extending laterally across said structure;

said transaxial wall being hinged to said upper rib and being hinged to said grip portion, and said axial wall being hinged to said intermediate panel and to said grip portion, such that said upper rib, said lower rib, said intermediate panel and said grip portion pivot generally toward a center area of said structure upon reduced internal container pressures.

2. A panel structure as set forth in claim 1 wherein said upper rib pivots generally about a horizontal axis.

3. A panel structure as set forth in claim 1 wherein said lower rib pivots generally about a horizontal axis.

4. A panel structure as set forth in claim 1 wherein said intermediate panel pivots generally about a longitudinal axis.

5. A panel structure as set forth in claim 1 wherein said grip portion pivots generally about a longitudinal axis.

6. A panel structure as set forth in claim 1 wherein said upper rib pivots generally in the direction of said lower rib.

7. A panel structure as set forth in claim 1 wherein said lower rib pivots generally towards said upper rib.

8. A panel structure as set forth in claim 1 wherein said intermediate panel pivots generally toward said grip portion.

9. A panel structure as set forth in claim 1 wherein said grip portion pivots generally toward said intermediate panel.

10. A panel structure as set forth in claim 1 wherein said upper and lower ribs pivot generally about horizontal axes and said intermediate panel and said grip portion pivot generally about longitudinal axes.

11. A panel structure as set forth in claim 1 wherein said upper and lower ribs pivot generally toward one another and said intermediate panel and said grip portion pivot generally toward one another.

12. A panel structure as set forth in claim 1 wherein said upper and lower ribs are of a common height and said intermediate panel and said grip portion are of differing heights with respect to one another and said upper and lower ribs.

13. A panel structure as set forth in claim 1 wherein said transaxial wall is hinged to said intermediate panel.

14. A panel structure as set forth in claim 13 wherein said transaxial wall is arcuate.

15. A panel structure as set forth in claim 13 wherein said transaxial wall arcs generally upward proceeding from adjacent said intermediate panel toward said grip portion.

16. A panel structure as set forth in claim 13 wherein said transaxial wall is curved and generally convex relative to said upper rib.

17. A panel structure as set forth in claim 1 wherein said lower rib is connected to said intermediate panel and said grip portion by a transaxial transition wall extending laterally across said structure.

18. A panel structure as set forth in claim 17 wherein said transaxial transition wall is arcuate.

19. A panel structure as set forth in claim 17 wherein said transaxial transition wall curves generally downward from a portion adjacent to said intermediate panel toward said grip portion.

20. A panel structure as set forth in claim 17 wherein said transaxial transition wall defines a convex curvature relative to said lower rib.

21. A vacuum-pinch grip panel structure of a hot-fillable container, said panel structure comprising:

an upper rib, a lower rib, an intermediate panel and a grip portion, said upper and lower ribs extending laterally across said structure, said intermediate panel and said grip portion extending between said upper and lower ribs; and said upper rib, said lower rib, said intermediate panel and said grip portion being connected together for relative movement therebetween, said movement being pivoting movement of said upper rib, said lower rib, said intermediate panel and said grip portion generally toward a center area of said structure upon reduced internal container pressures;

wherein said intermediate panel and said grip portion are interconnected by an axial transition wall extending between said upper and lower ribs, said axial wall is arcuate.

22. A panel structure as set forth in claim 18 wherein said axial wall is arcuate and generally concave relative to said grip portion.

23. A vacuum-pinch grip panel structure of a hot-fillable container, said panel structure comprising:

an upper rib, a lower rib, an intermediate panel, a grip portion and a recessed rib defined along upper and lower edges of said intermediate panel, said upper and lower ribs extending laterally across said structure, said intermediate panel and said grip portion extending between said upper and lower ribs;

said upper rib, said lower rib, said intermediate panel and said grip portion being pivotally connected together and to the container, such that said upper rib, said lower rib, said intermediate panel and said grip portion pivot generally toward a center area of said structure upon reduced internal container pressures.

24. A panel structure as set forth in claim 23 wherein said recessed rib is outwardly concave.

25. A blow molded, hot-fillable container comprising:

a neck defining an opening into said container, a shoulder portion, extending from said neck, a bottom closing off said container and a body extending between said shoulder portion and said bottom portion;

said body including a front label panel and a rear label panel;

a pair of panel structures, said panel structures being located on opposing sides of said container between said front label panel and said rear label panel;

said panel structure including an upper rib, a lower rib, an intermediate panel and a grip portion, said upper and lower ribs extending across said panel structure generally between said front label panel and said rear label panel, said intermediate panel and said grip portion located generally between said upper and lower ribs and being connected by an axial transition wall, said upper rib being connected to said grip portion, to said axial transition wall, and to said intermediate panel by an upper transaxial transition wall, and said lower rib being connected to said grip portion and to said intermediate panel by a lower transaxial transition wall, such that said upper rib, said lower rib, said intermediate panel and said grip portion pivot generally toward a center area of said structure upon reduced internal container pressures.

26. A container as set forth in claim 25 wherein said upper and lower ribs pivot generally about horizontal axes and said intermediate panel and said grip portion pivot generally about longitudinal axes.

27. A container as set forth in claim 25 wherein said upper and lower ribs pivot generally toward one another and said intermediate panel and said grip portion pivot generally toward one another.

28. A container as set forth in claim 25 wherein said upper and lower ribs are of a common height and said intermediate panel and said grip portion are of differing heights with respect to one another and said upper and lower ribs.

29. A container as set forth in claim 25 wherein said axial transition wall is substantially arcuate along a longitudinal axis of said container.

30. A container as set forth in claim 25 wherein said upper transaxial transition wall arcs generally upward adjacent to said front label panel toward said rear label panel and said lower transaxial transition wall arcs generally downward from adjacent said front label panel toward said rear label panel.

* * * * *